US008181766B2

(12) United States Patent
Michels

(10) Patent No.: US 8,181,766 B2
(45) Date of Patent: May 22, 2012

(54) ROLLER STORAGE SYSTEM

(75) Inventor: André Michels, Borgentreich (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 12/607,761

(22) Filed: Oct. 28, 2009

(65) Prior Publication Data

US 2010/0116839 A1 May 13, 2010

Related U.S. Application Data

(63) Continuation of application No. PCT/EP2009/005649, filed on Aug. 5, 2009.

(30) Foreign Application Priority Data

Aug. 13, 2008 (DE) ..... 10 2008 038 801

(51) Int. Cl.
*G07D 11/00* (2006.01)

(52) U.S. Cl. ..... 194/350

(58) Field of Classification Search ..... 194/350; 242/358.1, 907

See application file for complete search history.

(56) References Cited

U.S. PATENT DOCUMENTS

| | | | | | |
|---|---|---|---|---|---|
| 4,944,619 | A * | 7/1990 | Suzuki et al. | ..... | 400/224.2 |
| 5,354,009 | A * | 10/1994 | Buelens et al. | ..... | 242/348.4 |
| 5,732,878 | A | 3/1998 | Schroder et al. | | |
| 5,909,792 | A * | 6/1999 | Gerlier et al. | ..... | 194/206 |
| 6,003,667 | A * | 12/1999 | Barnett et al. | ..... | 206/396 |
| 6,003,924 | A * | 12/1999 | Nicol et al. | ..... | 296/37.6 |
| 6,371,473 | B1 * | 4/2002 | Saltsov et al. | ..... | 271/3.01 |
| 7,837,095 | B2 * | 11/2010 | Clauser et al. | ..... | 235/379 |
| 2002/0060400 | A1 | 5/2002 | Kobayashi et al. | | |
| 2002/0162775 | A1 | 11/2002 | Saltsov et al. | | |
| 2003/0116400 | A1 | 6/2003 | Saltsov et al. | | |
| 2006/0214350 | A1 | 9/2006 | Saltsov et al. | | |
| 2009/0166238 | A1 * | 7/2009 | Dickinson | ..... | 206/522 |

FOREIGN PATENT DOCUMENTS

| | | | |
|---|---|---|---|
| DE | 28 14 944 | A1 | 10/1979 |
| DE | 198 58 350 | A1 | 6/2000 |
| EP | 0 795 842 | A2 | 9/1997 |
| WO | WO-01/54078 | A2 | 7/2001 |
| WO | WO-2007/014803 | A1 | 2/2007 |

* cited by examiner

*Primary Examiner* — Mark Beauchaine

(74) *Attorney, Agent, or Firm* — Harness, Dickey & Pierce, P.L.C.

(57) ABSTRACT

A roller storage system is described consisting of a storage roller (200) for storing banknotes, where the storage roller (200) is operated in a money processing system. The roller storage system is characterized in that the system comprises a container (100) in which the storage roller (200) is disposed, the container (100) has at least one means that enables the guided insertion of the container (100) into the money processing system and/or the guided removal of the container (100) from the money processing system.

18 Claims, 11 Drawing Sheets

ROLLER STORAGE SYSTEM

BACKGROUND OF THE INVENTION

1. Technical Field

The invention relates to a roller storage system with a storage roller to store bank notes. In a storage roller, the banknotes are stored between the winding plies of one or two strip-shaped films that are spooled back and forth between a film drum and a winding drum. Storage rollers of this kind are also described as winding storage mechanisms or film storage mechanisms.

2. Discussion

Storage rollers are used in addition to, or as an alternative to, cassettes in money processing systems for storing banknotes, wherein the banknotes are stacked next to, or on top of, each other in cassettes, in contrast to storage rollers.

Any automat for depositing or dispensing banknotes is included in the category of money processing system. Thus, staffed teller systems as well as self-service automats fall under the term money processing system, for example:

automated teller machines operated by banks, automats that are operated in retail establishments in conjunction with a payment station as a POS money processing automat (point-of-sale automat), so called automated safes that are operated in a branch bank or in a cashier's office of a retail establishment.

There is a demand now for the ability to exchange storage rollers between different money processing systems. In order to simplify cash flow for example, a storage roller filled with banknotes is to be removed from one POS automat in a retail establishment and inserted into an automated safe in a cashier's office for "recycling", where the full storage roller is emptied.

The storage rollers known from the prior art (DE 198 58 350 A1) and US 2003/0116400A1) are both permanently installed in a money processing system.

SUMMARY OF THE INVENTION

An object of the invention is to create a roller storage system in which a storage roller can be exchanged easily and reliably between different money processing systems.

In accordance with the invention, a roller storage system is provided that comprises a container in which the actual storage roller is located. For this, the container has at least one means that enables the guided insertion of the container into the money processing system and/or the guided removal of the container from the money processing system.

Means of the guided insertion/removal are specifically guide rails or guide channels located on the container that coact with corresponding guide rails or guide channels on the money processing system upon insertion and/or removal.

In addition to, or as an alternative to, the guide rails or guide channels, a handle can be located on the container in such a way that the container can be pushed by means of the handle as it is being inserted into the money processing system and/or pulled as it is being removed from the money processing system.

The storage roller system in accordance with the invention makes it possible to insert and to remove again, in a simple and reliable manner, a generic storage roller that is intended for permanent installation in a money processing system, by embedding said storage roller in a container with suitable guide/handling means into a money processing system. In this way, a generic storage roller can be exchanged among different money processing systems in a simple and reliable manner.

It is thereby also possible to exchange the storage roller container for a conventional money cassette in which banknotes are disposed next to or above each other in the form of a stack.

BRIEF DESCRIPTION OF THE DRAWINGS

The invention shall be explained in greater detail hereinafter using the attached drawings.

DESCRIPTION OF THE PREFERRED EMBODIMENTS

Figure 1A:
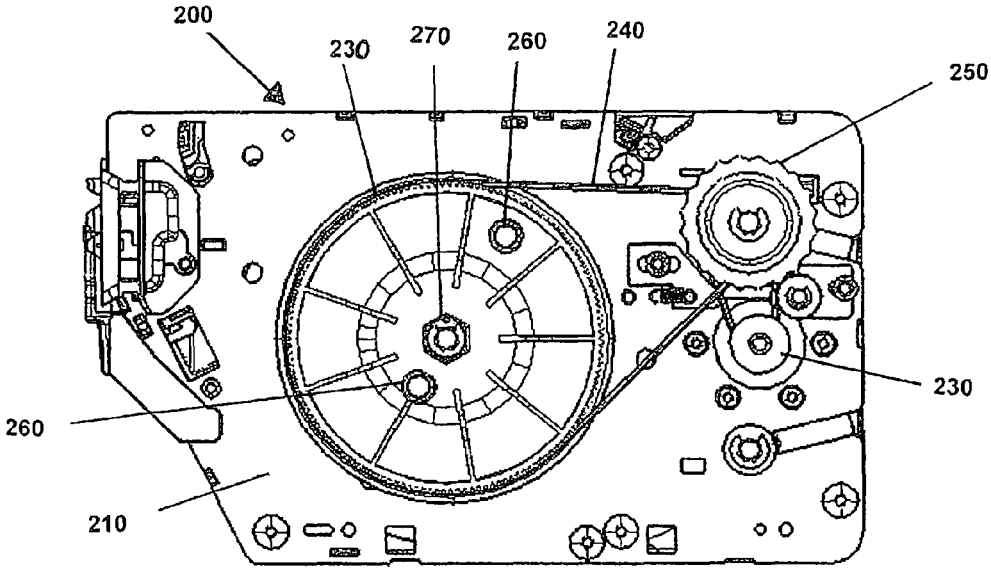
FIG. 1A shows a side elevation of the container before insertion of the storage roller, FIGS. 2A/2B show perspective views of the roller storage system with storage roller located in the container, with the container open.
Figure 1B:
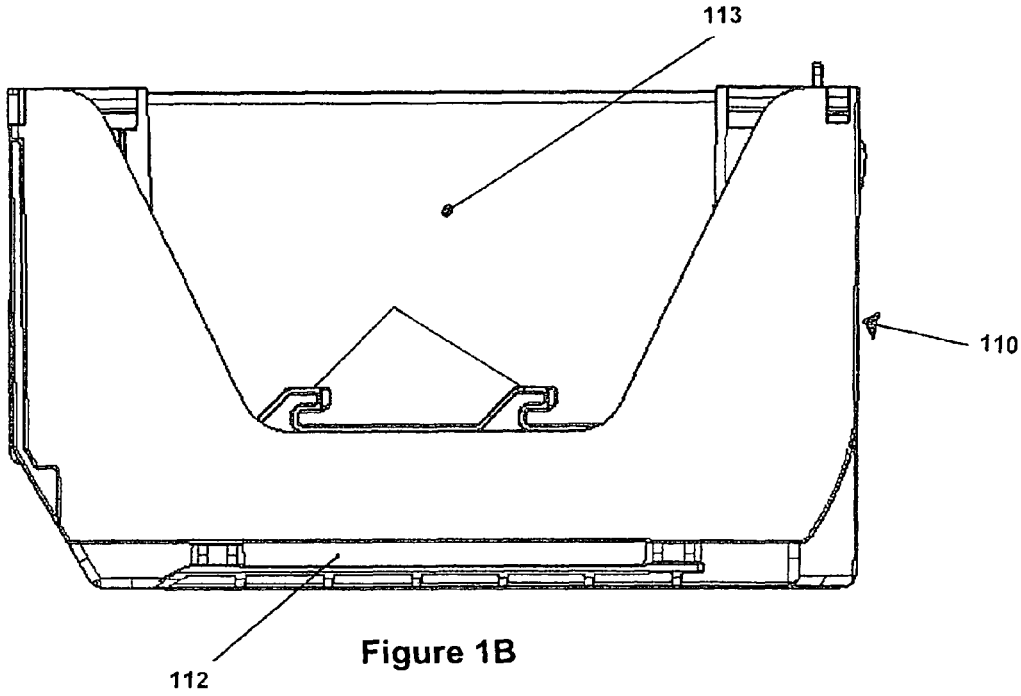
FIG. 1 shows a side elevation of a generic storage roller before insertion into the container.

FIG. 1 shows a side elevation of a generic storage roller (200). The storage roller (200) per se has two side walls (210) between which the at least one film drum (not shown) is located. Cog belt sprockets (230) and cog belts (240) are located on the side wall (210) shown in FIG. 1 to drive the film/winding drums carried between the side walls (210). An electric motor for the motorized drive is disposed on the back side of the side wall (210) and not visible in this view. A handwheel (250) is also provided on this side panel (210) for manual actuation of the drive in the event of service/maintenance.

FIG. 1A shows a side elevation of the container (100), or rather of the lower part of the container (110), in which the generic storage roller (200) will be located.

As can be seen, the container (100), specifically the lower part of the container (110), has a guide channel (112) on two oppositely located sides that coact with corresponding guide rails (not shown) on the money processing system. Instead of guide channels (112), the container (110) may also have guide rails which then coact with corresponding guide channels on the money processing system.

The guide channels (112), or guide rails, on the container (100) can be produced particularly easily and cost-effectively if they are produced from plastic in one piece with the container (100).

Figure 2A:
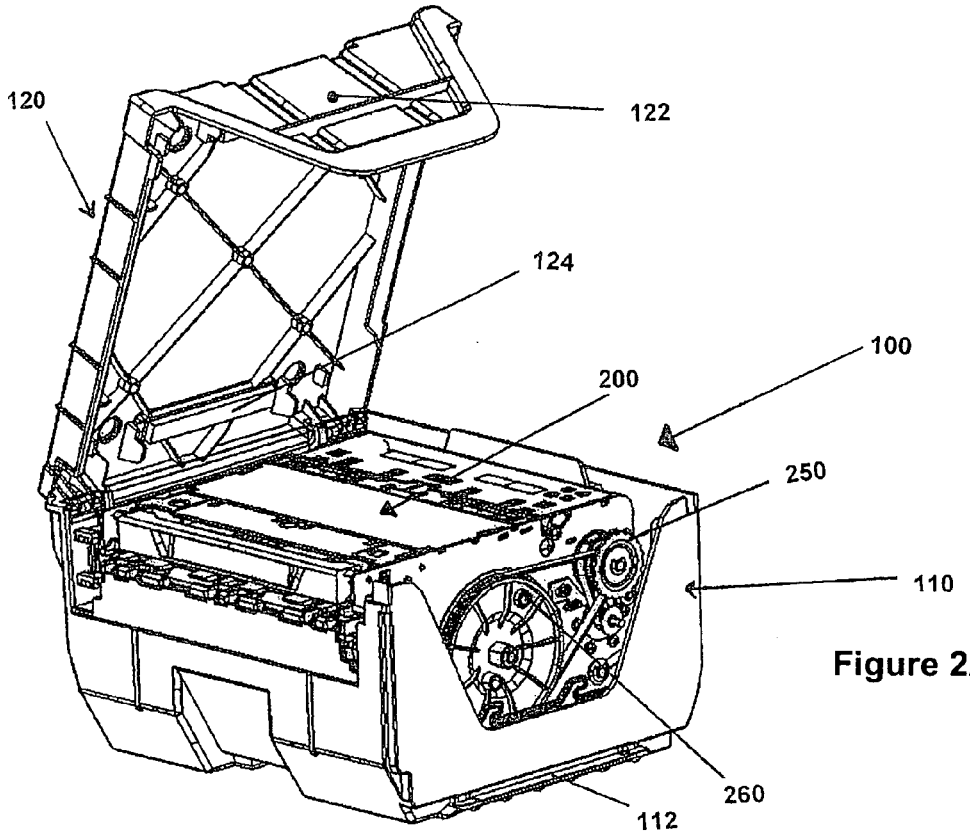
Figure 2B:
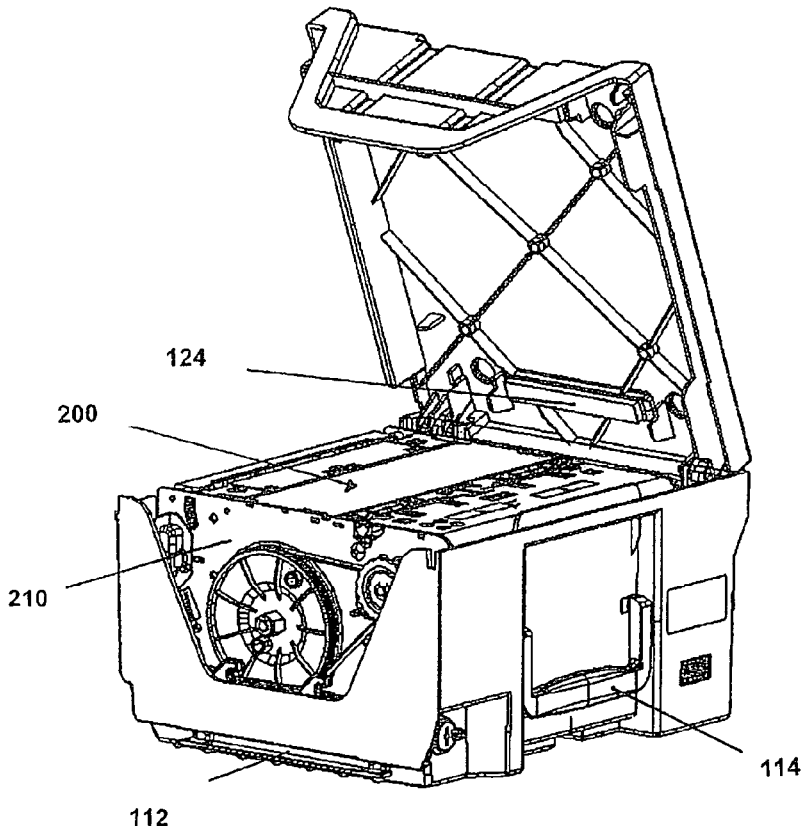

Perspective drawings of the storage roller system with storage rollers (200) disposed in the container (100), with the container open in each case, are shown in FIGS. 2A and 2B.

Figure 14:
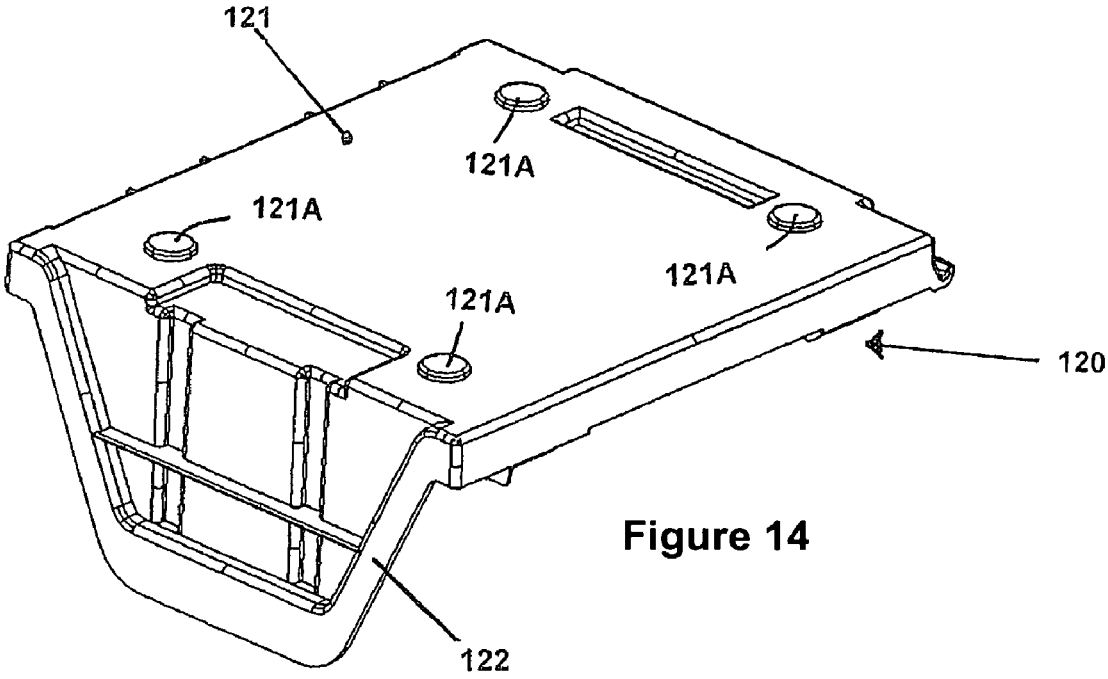
FIG. 14 shows a perspective view of the upper part of the container, where the outside of the cover of the upper part of the container is visible.
Figure 15:
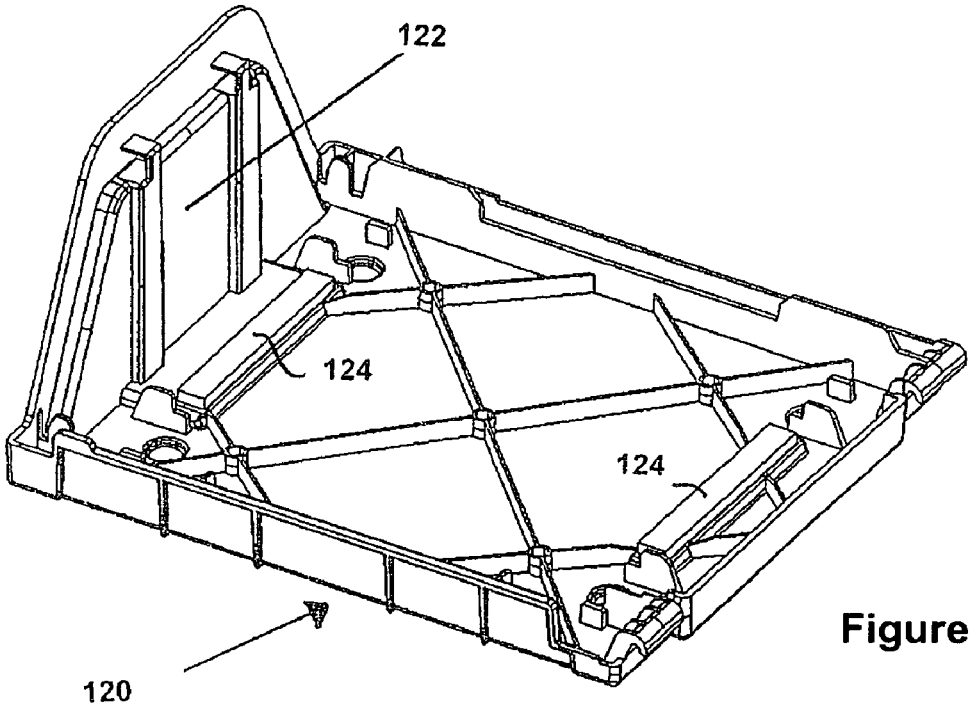
FIG. 15 shows a perspective view of the upper part of the container, where the outside of the cover of the upper part of the container is visible.
Figure 16:
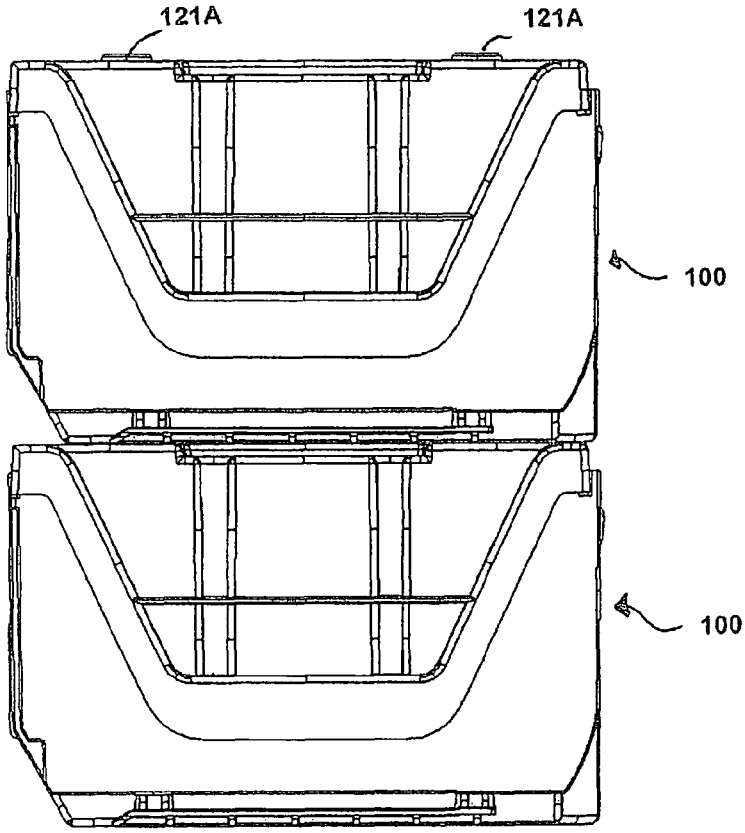
FIG. 16 shows a side elevation of two containers stacked one on top of the other.
Figure 17:
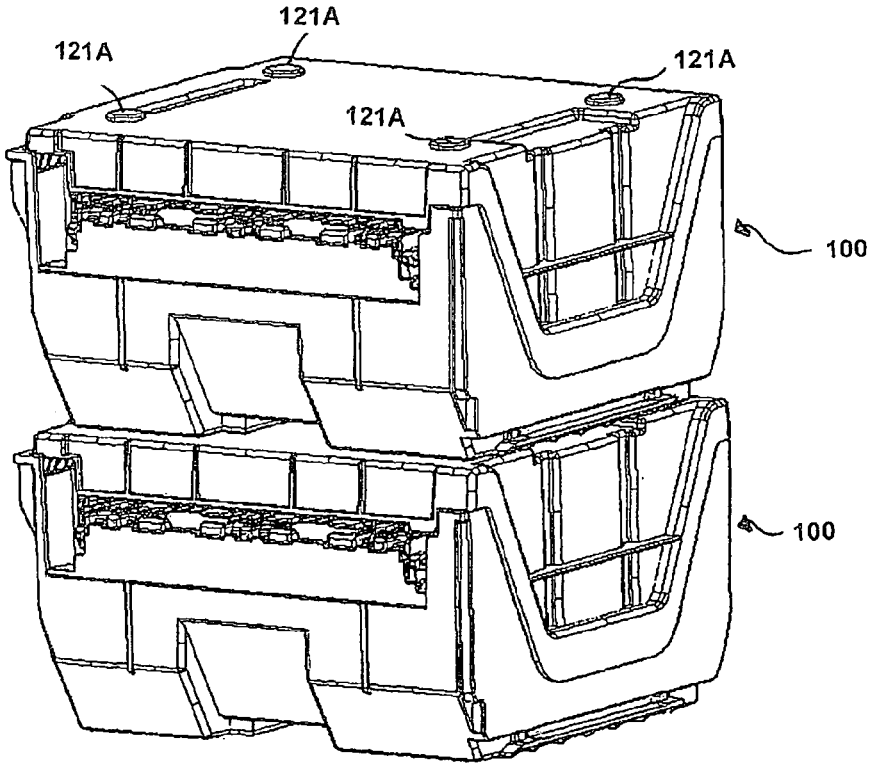
FIG. 17 shows a perspective view of two containers stacked one on top of the other, FIGS. 18A/B show different views of a cover plate that is inserted into the lower part of the container below the banknote transfer slot.
Figure 18A:
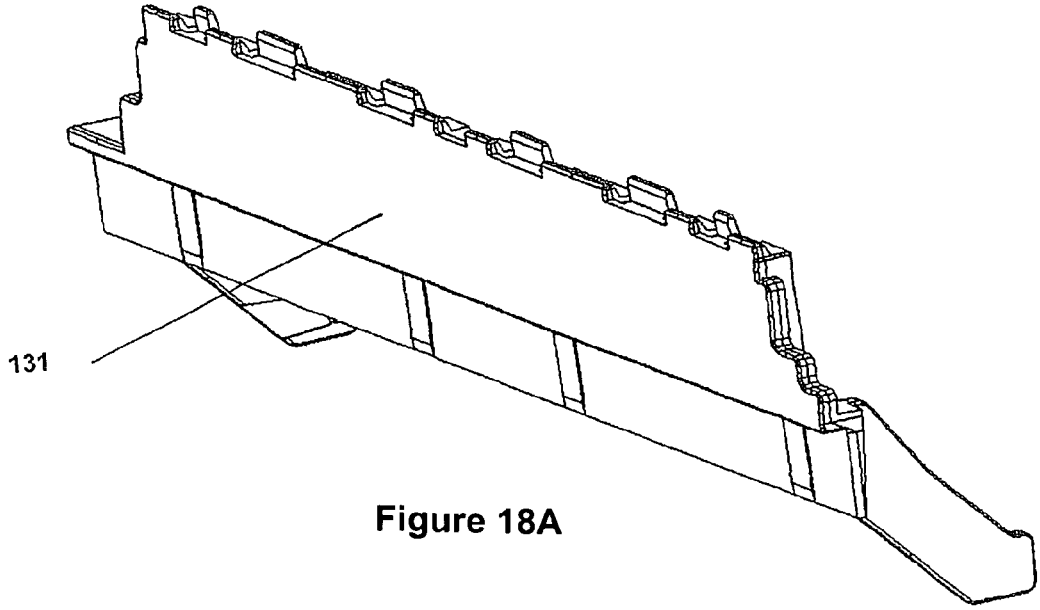
Figure 18B:
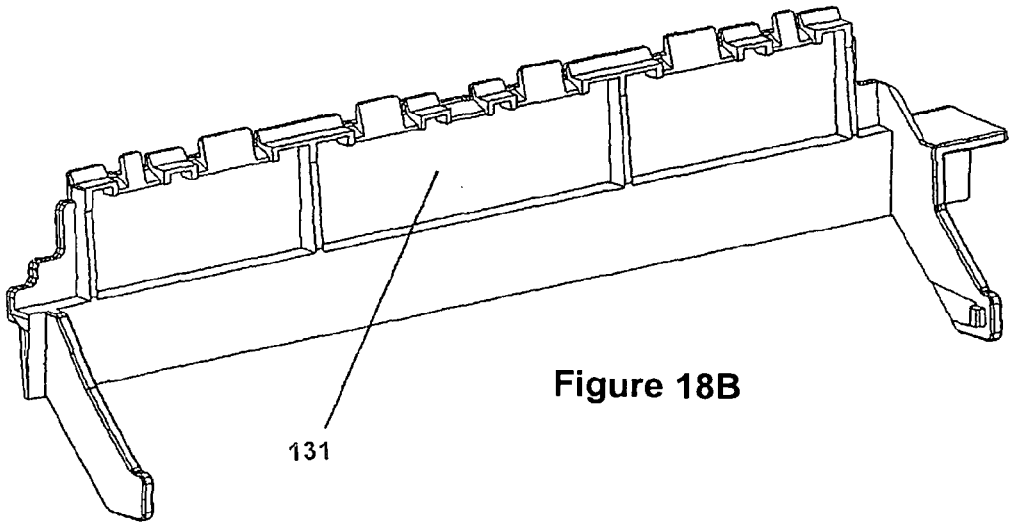

The container (100) consists of a container lower part (110) and a container upper part (120), where the upper part of the container (120) is disposed pivotably and/or removably with respect to the lower part of the container (110). The pivotably removable arrangement of the upper part of the container (120) on the lower part of the container (110) will be discussed in greater detail in conjunction with FIGS. 14 and 15.

It can be seen in FIG. 2B that a handle (114) is located on the container (100), preferably on the lower part of the container (110), such that the container (100) can be pushed by means of the handle (114) when being inserted into the money processing system and/or pulled when being removed from the money processing system. The handle (114) is carried in a recess in the container wall so that it can pivot. When not in use (corresponding to position in FIG. 2B), the handle (114) lies in the recess. When positioned for use, the handle is pivoted about 90° (not shown). To enable the insertion or the withdrawal of the container (100) in conjunction with the guide channels (112) and assisted by the handle (114), the handle (114) is positioned on the side of the container lying between the two sides of the container that have the guide channels (112). The orientation for manipulating the handle (114) when the container (100) is pushed into and withdrawn from the money processing system is thus parallel to the guide channels (112). Outside the money processing system, the handle (114) serves additionally to carry the container (100) easily and safely, including the storage roller (200) located therein.

When the container (100) is closed, a slot (130) exists between the lower part of the container (110) and the upper part of the container (120) for the transfer of banknotes from the money processing system to the storage roller (200) and/or from the storage roller (200) to the money processing system. This banknote transfer slot (130) is clearly recognizable in FIG. 3. The handle (114) is preferably located on the side of the container (100) lying opposite the slot (130) since, when being inserted into the money processing system, the container (100) is pushed in with the slot (130) at the front, facing towards a banknote removal and/or feed unit (not shown) located in the money processing system. The handle (114) is always freely accessible as a result of the disposition selected for said handle.

The storage roller (200) is preferably installed in the container (100) so that it can be detached. To install the storage roller (200) into the container (100), the upper part of the container (120) is pivoted up and/or removed so that the storage roller (200) can be inserted into the lower part of the container (110). The detachable arrangement of the storage roller (200) in the container (100) has the advantage that the storage roller (200) can be removed easily from the container (100) for more complex service and maintenance operations and re-inserted.

The detachable installation of the storage roller (200) in the container (100) is advantageously implemented by snap mechanisms (115) provided in the lower part of the container (110) that form a snap-fit connection with corresponding mating elements (211) on the storage roller (200). No tool, or the simplest of tools at most, is required for latching when inserting the storage roller (200) or unsnapping when removing the storage roller (200). The insertion and the removal of the storage roller (200) can be carried out simply and quickly.

Figure 4:
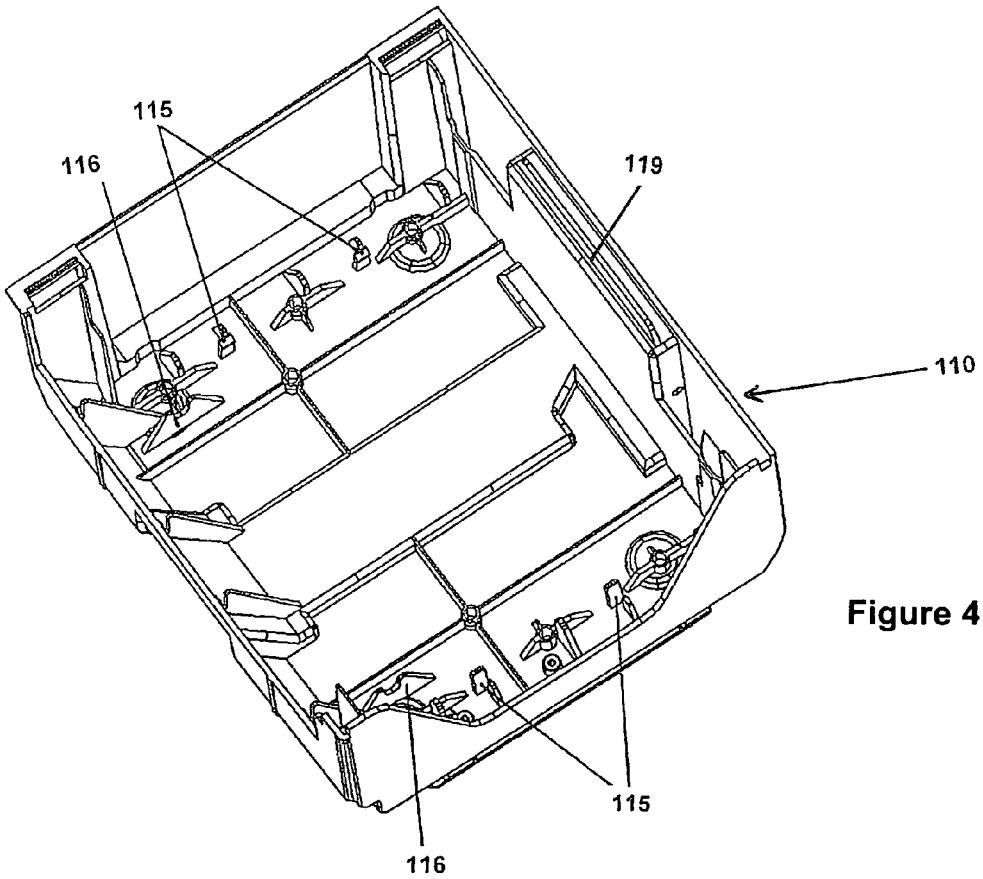
FIG. 4 shows a perspective view of the lower part of the container without storage roller.
Figure 5:
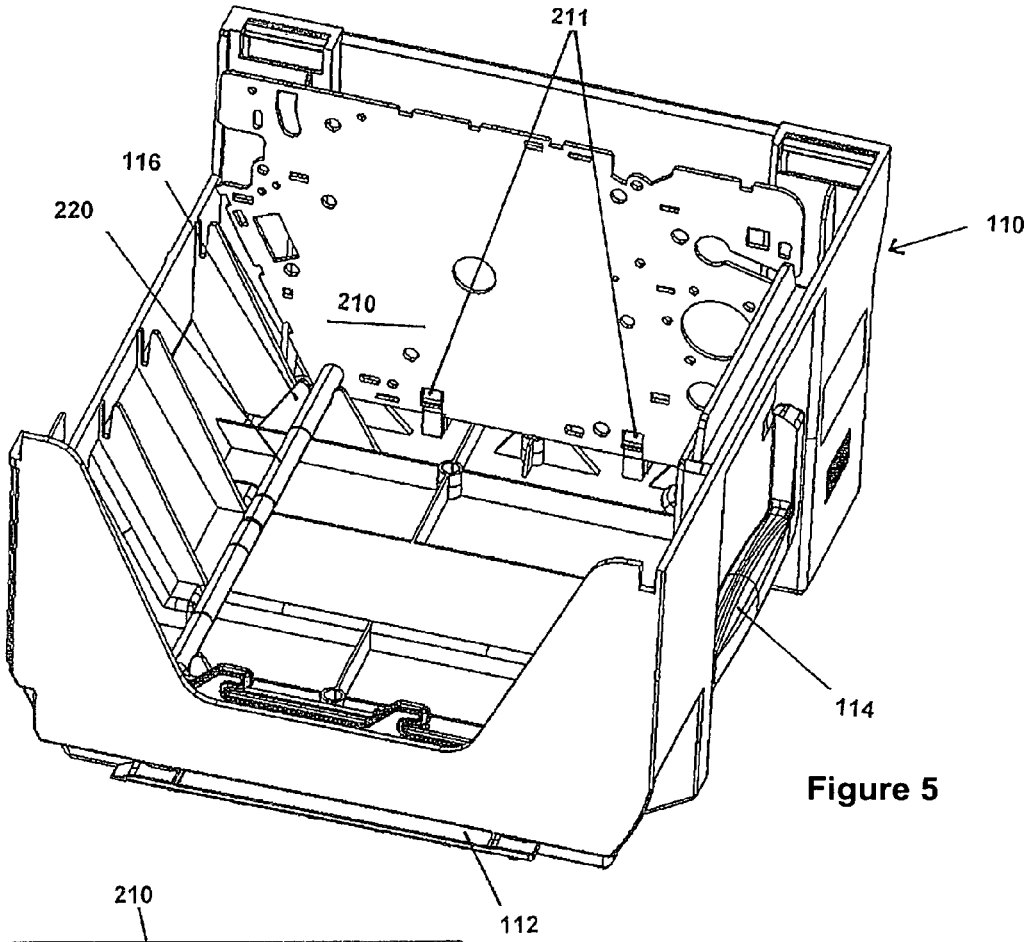
FIG. 5 shows a perspective view of the lower part of the container, where a side panel for the storage roller is drawn in to clarify the detachable installation of the storage roller in the container.
Figure 6:
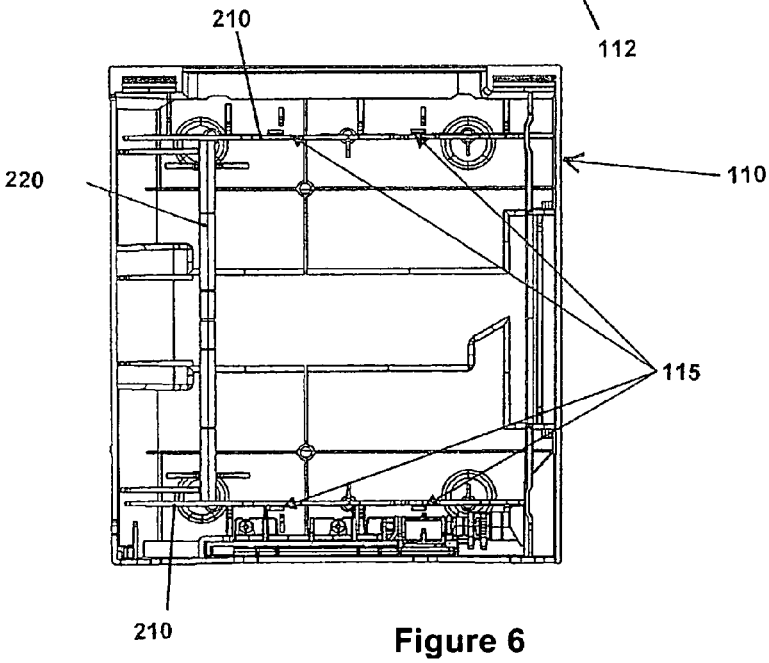
FIG. 6 shows a plan view of the lower part of the container with the side panels for the storage roller inserted.
Figure 7:
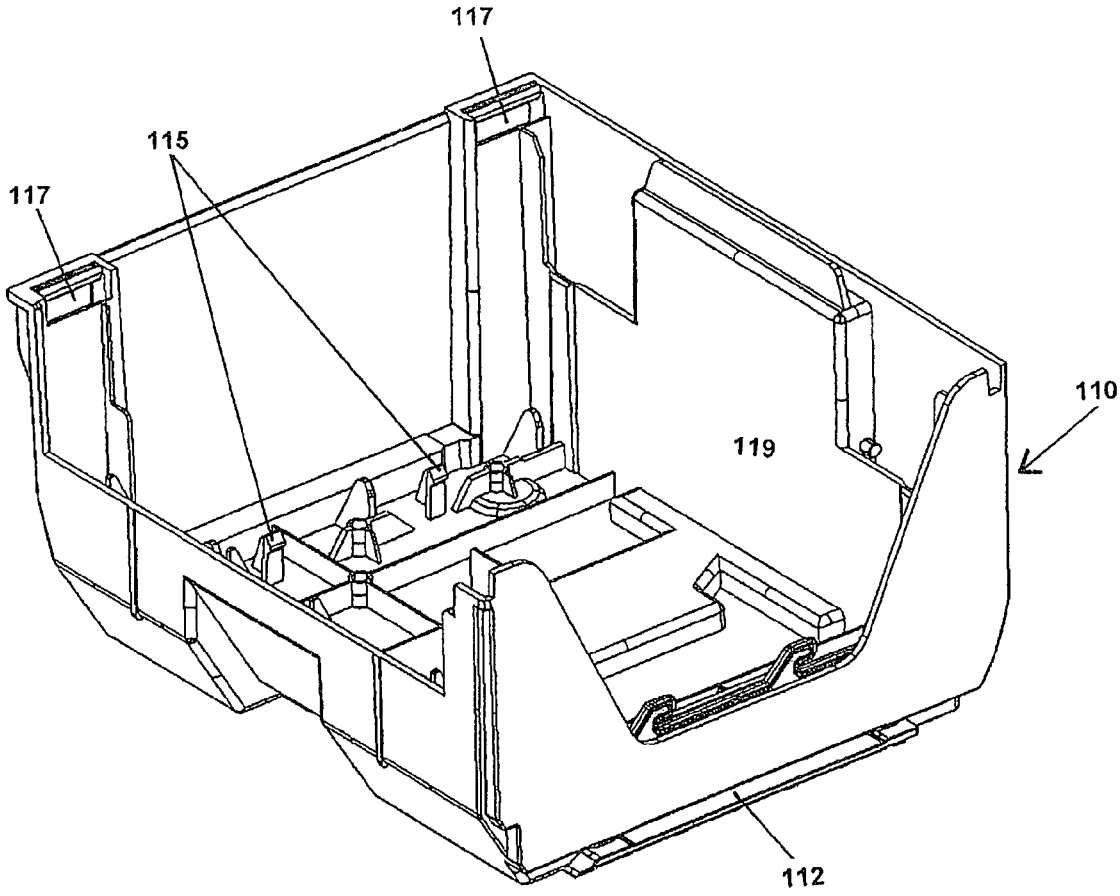
FIG. 7 shows a further perspective view of the lower part of the container.
Figure 8:
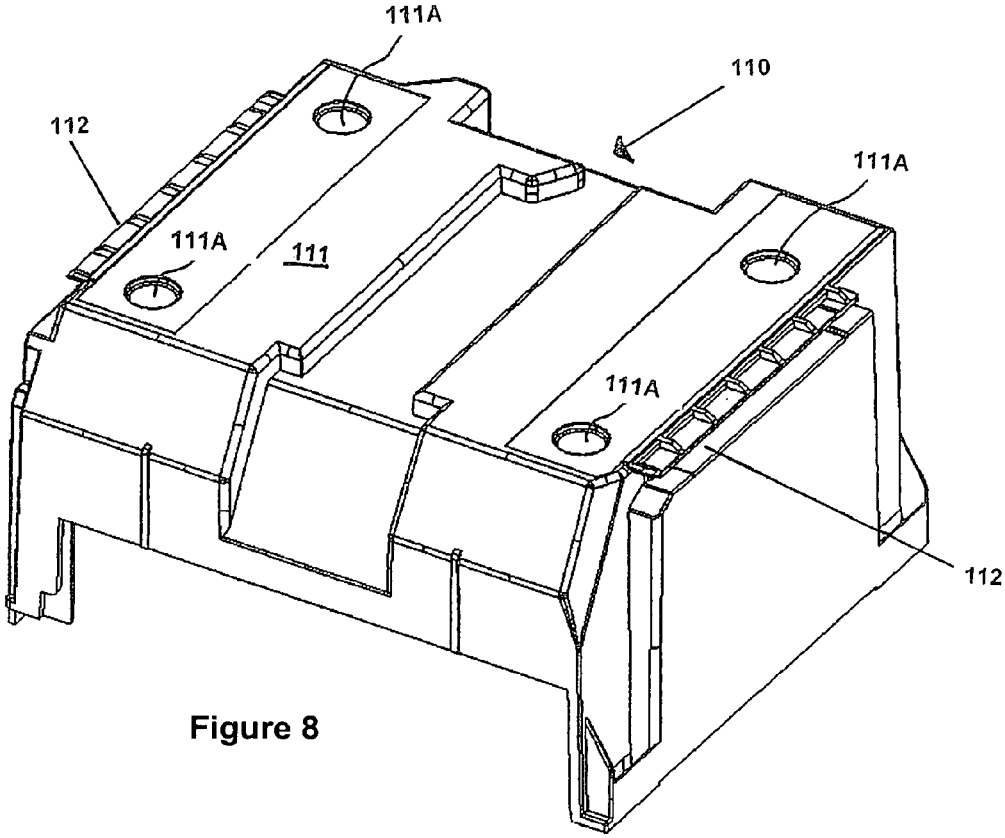
FIG. 8 shows a perspective view of the lower part of the container in which the floor of the lower part of the container is visible.
Figure 9:
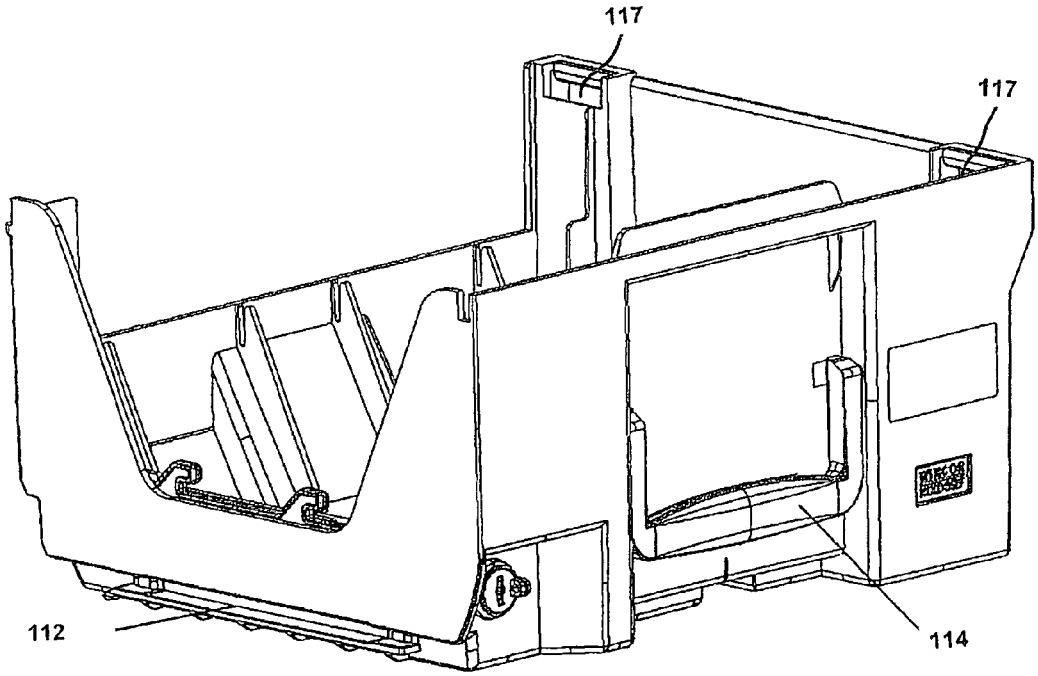
FIG. 9 shows a perspective view of the lower part of the container in which the handle is visible, FIGS. 10/11 show further perspective views of the lower part of the container.
Figure 10:
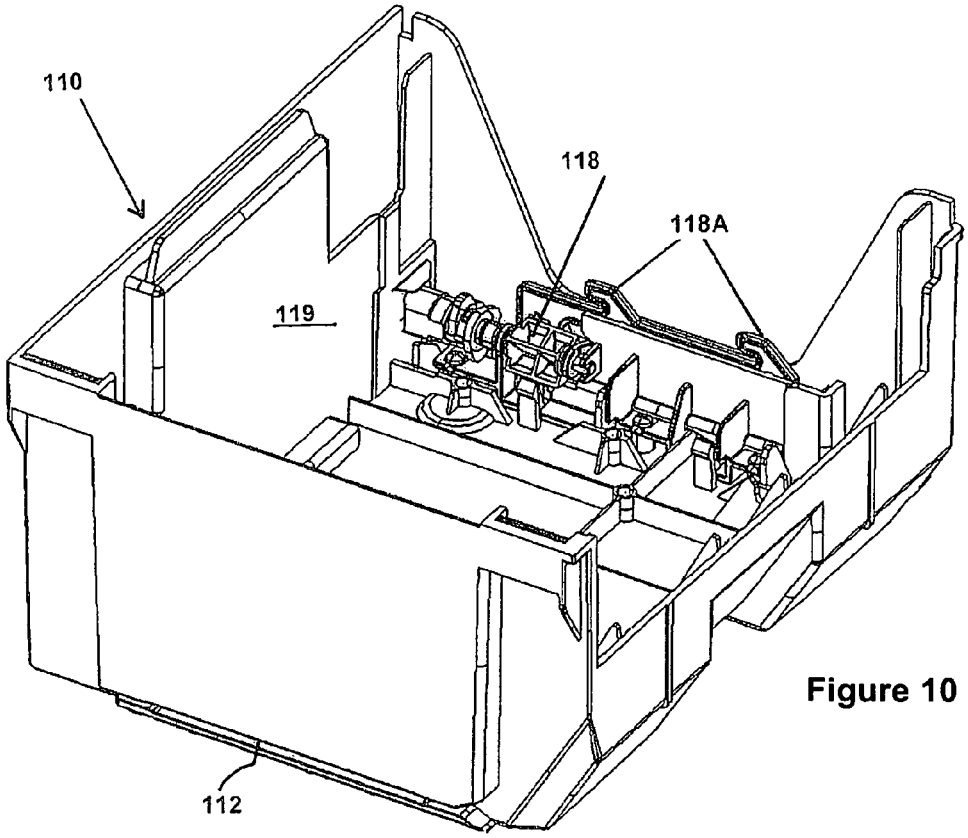
Figure 11:
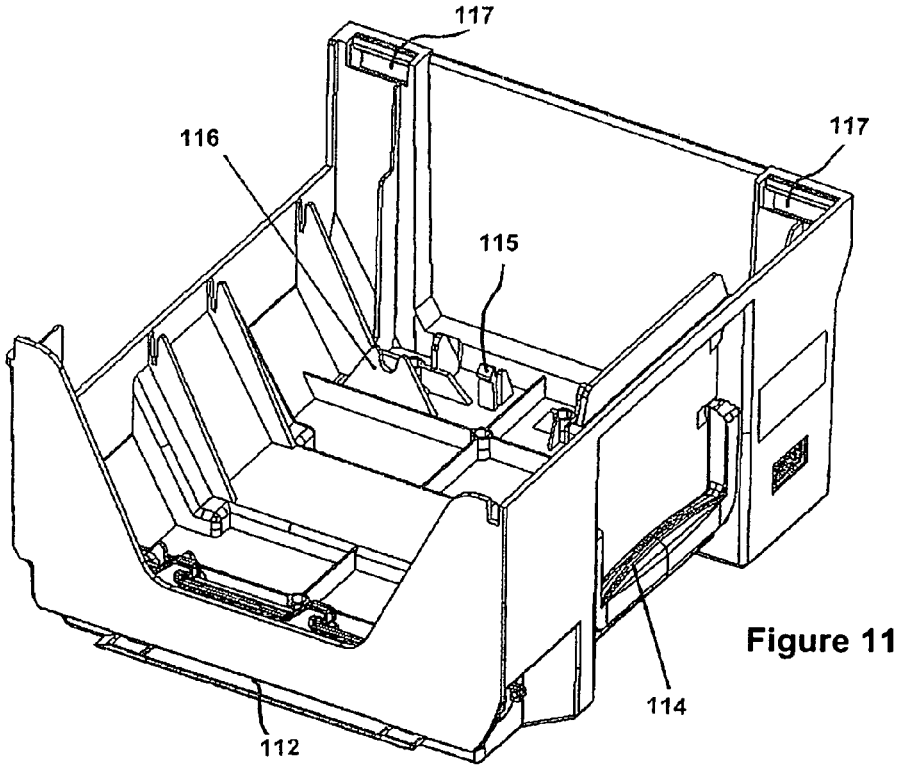

The snap mechanisms configured as catch hooks (115) on the floor (111) of the lower part of the container (110) are particularly clearly recognizable in FIGS. 4 and 7. These catch hooks (115) engage in recesses (211) that are formed in the side panels (210) of the storage roller (200). A side wall (210) snapped in place in the lower part of the container (110) is shown in FIG. 5 for clarification. The remaining components of the storage roller (200) were omitted for reasons of clarity. FIG. 6 shows a plan view of the open lower part of the container (110) with the two side walls (210) for the storage roller snapped in place. The remaining details of the storage roller (200) were also omitted here for the sake of clarity.

In order to fix the position of the storage roller (200) better, which is only located detachably in the container (100), seats (116) to fix the position of the storage roller (200) are positioned in the container (100), where a shaft (220) for the storage roller (200) is carried in the seats (116). As an example, a spacer shaft (220) located between the two side walls (210)—see FIGS. 5 and 6—can be used for this purpose. When the storage roller (200) is inserted into the container (100), this shaft (220) is simply placed in the seats (116), whereby the shaft (220) and thus the entire storage roller (200) is moved into a correct position. When the storage roller (200) is removed from the container (100), the shaft (220) is simply lifted out of the seats (116). The seats (116) thus compensate for any tolerance in the snap-fit connection between the lower part of the container (110) and the storage roller (200).

Figure 3:
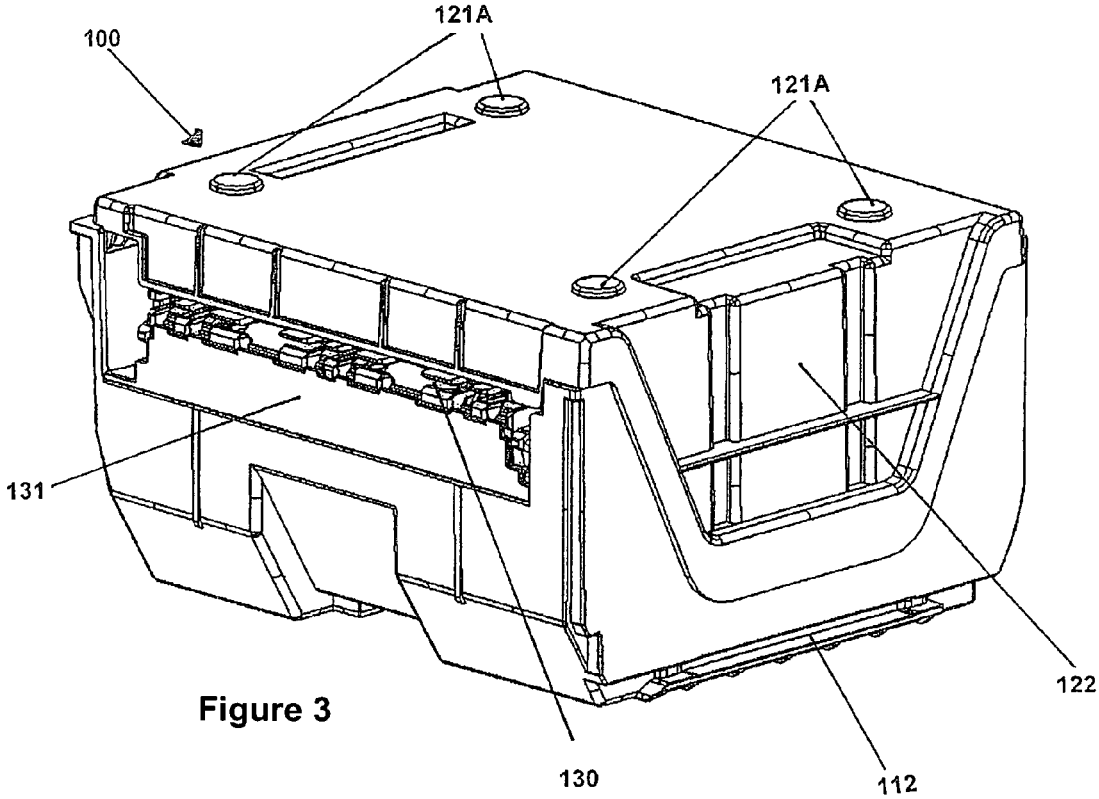
FIG. 3 shows a perspective view of the closed container with a storage roller located therein.

In conjunction with FIGS. 2A, 2B and 3, a further unique feature of the roller storage system in accordance with the invention shall be discussed in more detail, namely that one side wall of the lower part of the container (110) has at least one partially cut-out section (113) corresponding to which a side panel (122) is disposed on the cover (121) of the upper part of the container (120) which closes off the cut-out section in the side wall of the lower part of the container (110) when the container (100) is closed. Access is provided to the drive for the storage roller (200) through this cut-out section (113) in the side wall of the lower part of the container (110) when the container (100) is open, that is to say, with the upper part of the container (120) pivoted up or removed. In this way, the film/winding drum of the roller storage system (200) can be rotated manually outside the money processing system in the event of service or maintenance in a very simple manner in order to correct a banknote jam or similar, for example, without the storage roller (200) having to be removed from the container for this purpose. The cog belt sprockets (230) and cog belts (240) of the drive for the film and winding drums carried between the side panels (210) are located behind the side panel (122). By swinging up or removing the upper part of the container (120) on which the panel is disposed, said drums are freely accessible. A hand wheel (250) is preferably provided, located on an input, output or jockey shaft, so that by rotating the handwheel (250), with its haptically advantageous design, the film/winding drums can be rotated manually. Of course, even without a handwheel, it is possible to provide drive easily in a manner consistent with the invention by rotating the cog belt sprockets (230) or cog belts (240) directly by hand.

Provision is made moreover in one embodiment, to provide means at least on one of the cog belt sprockets (230) that allow the use of an external manual or powered rotary tool to provide drive to the storage roller, i.e. to rotate the film/winding drum. These means may be an eccentrically located sleeve (260) or an eccentrically located pin, into which or over which a mating pin or sleeve of a hand crank can be inserted or positioned. Alternatively, or additionally, a means configured as a hexagonal nut (270) can be provided that is disposed on the cog belt sprocket shaft and can be operated by a hexagonal wrench. In particular when the entire supply of banknotes stored in the roller storage system (200) is to be withdrawn from the storage roller (200) outside a money processing system, the use of a powered rotary tool is suggested.

Figure 13:
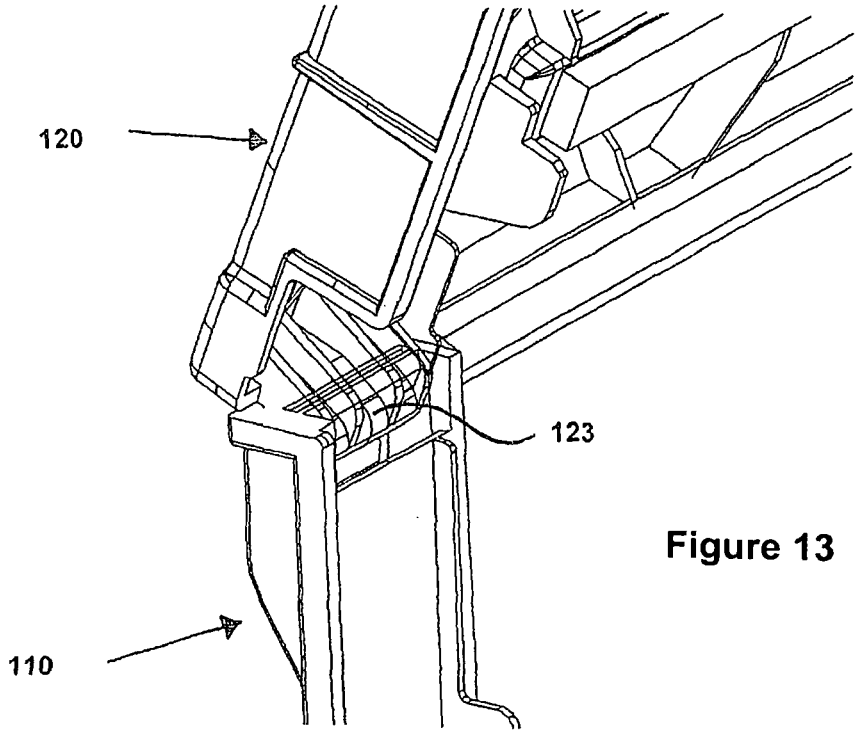
FIG. 13 shows an enlarged representation of the pivotable attachment of the upper part of the container to the lower part of the container.
Figure 12:
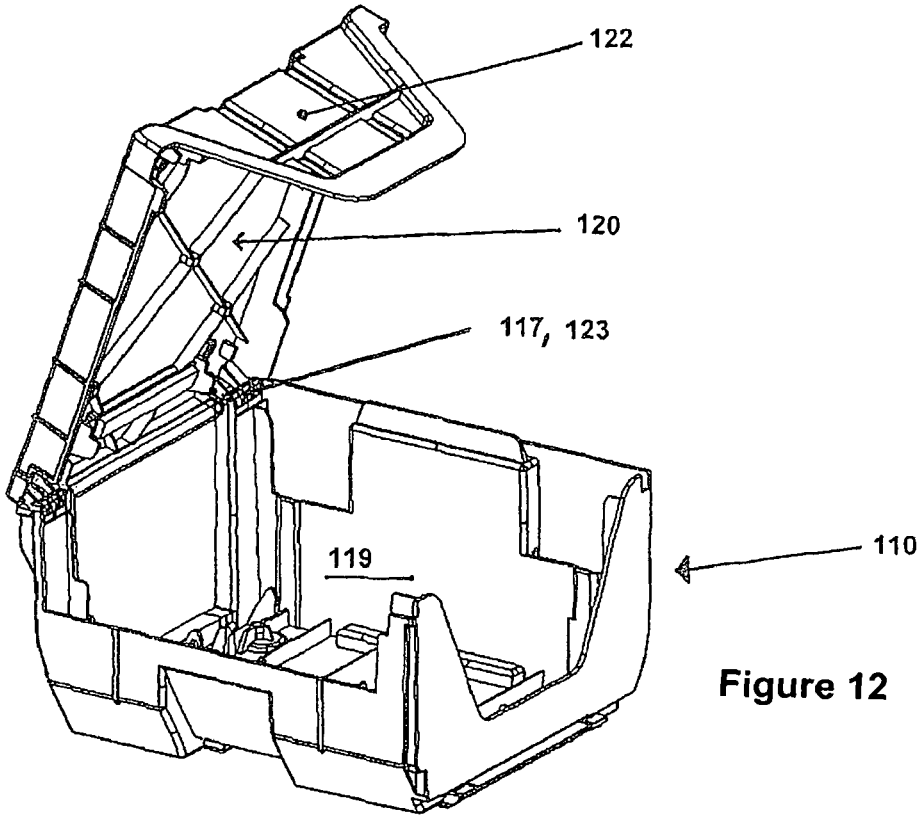
FIG. 12 shows a perspective view of the lower part of the container with the upper part of the container pivoted aside.

The disposition of the upper part of the container (120) on the lower part of the container (110) shall be explained In conjunction with FIGS. 12 and 13. The upper part of the container (120) is disposed on the lower part of the container (110) to be pivotable and removable, where the upper part of the container (120) and the lower part of the container (110) are joined together in the manner of a hinge so as to be detachable. To this end, the lower part of the container (110) has two recesses (117) forming the hinge-like connection into which an open hinge bushing (123) can be respectively mounted, wherein the hinge bushings (123) partially encompass an undercut formed on the recess (117). In this way, the container upper part (120) can be removed and replaced easily and without tools for service or maintenance purposes. To remove the container upper part (120), it suffices if said upper part is pivoted up by an order of magnitude of about 45°. From this position, the hinge bushings (123) can be unhooked from the recesses so that the upper part of the container (120) can be removed. Installation of the upper part of the container (120) is carried out in the reverse order.

When the container (200) is closed, the upper part of the container (120) is mechanically locked with respect to the lower part of the container (110) so that the container (100) can be transported without difficulty, without the risk of the upper part of the container (120) opening unexpectedly. By means of a suitable lock, the locking device (118) can be sealed so that the container (100) is secure against tampering. Unauthorized opening of the container (100) is not possible without damage and without leaving traces. The locking device (118) located on the container lower part (110) comprises sliding bolts (118*a*) that engage matching elements (not shown) on the container upper part (120) in the locked position.

Preferably at least one damping element (124), specifically a foam element, is provided on the inside in the cover (121) of the upper part of the container (120) that is located under preload between the cover (121) of the upper part of container (120) and the storage roller (200) when the container (100) is closed. In this way, the upper part of the container (120) can be locked to the lower part of the container (110) in the bolted position without free play. Since the upper part of the container (120) is only joined to the lower part of the container (110) with a certain tolerance because of the detachable hinge-type arrangement and the type of container latch, the upper part of the container (120) would otherwise rattle unpleasantly when the container (100) is transported outside the money processing system, or when the storage roller (200) is operating in the money processing system. In the embodiment shown in the drawings, two strip-like foam elements (124) are provided that press on the side walls (210) of the storage roller.

For the contingency that the container (100) is accidentally dropped and hits the ground when it is being transported outside the money processing system, which can never be entirely excluded, the container (100) is configured at least in part with double walls, where the double wall (119) of the energy absorption serves to protect the storage roller (200) during an impact of the container (100). The most expensive component of the roller storage system (container, storage roller), namely the storage roller (200) itself, is protected from damage.

For the contingency that the requirement exists for stacking two or more containers (100) outside a money processing system, the following measure is provided in accordance with the invention to design stackability simply and reliably. The floor (111) of the lower part of the container (110) has at least one depression (111A) on the outside, while the cover (121) of the upper part of the container (120) has at least one elevation on the outside (121A). One container (100) can be stacked on another identically constructed container (100) as the at least one elevation (121A) on the cover (121) of the one container (100) coacts with the depression (111A) on the bottom (111) of the other container (100). Of course, the elevations can also be located on the bottom of the lower part of the container and the depressions on the cover of the upper part of the container (not shown). In the embodiment shown, four circular depressions (111A) and elevations (121A) are provided respectively. As a result of the co-action of the elevations (121A) and depressions (111A), it is ensured firstly that the containers (100) are stacked flush one on top of the other and secondly that the containers (100) cannot slip.

The storage roller system in accordance with the invention additionally makes it possible to render the banknotes stored in the storage roller unusable by dying them with ink in the event of unauthorized manipulation or a robbery, since the container for the ink supply and the trigger mechanism to active the ink dying can also be housed in the container.

The invention claimed is:

1. A roller system having a storage roller for storing banknotes, said system comprising:

a storage roller comprising a film a drum around which banknotes are wound;

a container in which the storage roller is disposed and removable in an upwards direction, and guide members on outer portions of the container cooperating with guide members of one money processing system to secure the container in an operable relation with the one money processing system in which bank notes can be retrieved from or fed to the storage roller in the container, the guide members further permitting the removal of the container from the one money processing system and the transportation of the container to another system where the guide members cooperate with guide members on the other money processing system to secure the container in an operable relationship with the other money processing system in which bank notes can be retrieved from or fed to the storage roller in the container.

2. The roller storage system of claim 1 , wherein guide channels or guide rails are disposed on the container that coact with corresponding guide rails or guide channels on the money processing system during insertion and/or removal.

3. The roller storage system of claim 2, wherein the guide channels or guide rails are configured in synthetic material in one piece with the container.

4. The roller storage system of claim 2, wherein a handle is disposed on the container in such a way that the container can be pushed during insertion into the money processing system and/or pulled during removal from the money processing system by way of the handle.

5. The roller storage system of claim 1, wherein the container consists of a container lower part and a container upper part , where the upper part of the container is disposed to be pivotable and/or removable with respect to the lower part of the container.

6. The roller storage system of claim 5, wherein snap elements are disposed in the lower part of the container for the detachable installation of the storage roller.

7. The roller storage system of claim 5, wherein, with the container closed, a slot exists between the lower part of the container and the upper part of the container for the transfer of banknotes from the money processing system to the storage roller and/or from the storage roller to the money processing system.

8. The roller storage system of claim 5, wherein one side wall of the lower part of the container has at least partially a cutout, a side panel is disposed on the upper part of the container which closes off the cutout in the sidewall of the lower part of the container when the container is closed, wherein a drive for the storage roller can be accessed through the cutout in the sidewall of the lower part of the container with the container open.

9. The roller storage system of claim 5, wherein in the upper part of the container at least one damping element, is provided on the inside that is located under preload between the upper part of the container and the storage roller when the container is closed.

10. The roller storage system of claim 1, wherein in the lower part of the container seats are disposed to fix the position of the storage roller in the container, where a shaft for the storage roller is carried in the seats.

11. The roller storage system of claim 1, wherein the container is configured at least partially with a double wall, where the double wall serves to absorb energy in an impact of the container to protect the storage roller.

12. The roller storage system of claim 1, wherein the lower part of the container has a floor with at least one depression or elevation on the outside, the upper part of the container) has at least one elevation or depression on the outside, wherein the container can be stacked on another identically constructed container where the at least one depression or elevation on the upper part of one container coacts with the elevation or depression on the floor of the other container.

13. Apparatus for use in at least two spaced apart money processing systems, said apparatus comprising:

a bank note storage roller having a drum around which bank notes are stored;

a container having a floor, side walls and a pivotal cover hinged to a side wall;

the container having a slot; and the bank note storage roller being removable in an upwards direction from the container and mounted in the container so that bank notes can be retrieved from the drum or fed to the drum through the slot; and guide members on outer portions of the container cooperating with guide members of one of the money processing systems to secure the container in an operable relation with the one money processing system in which bank notes can be retrieved from the drum or fed to the drum through the slot in the container, the guide members further permitting the removal of the container from the one money processing system and the transportation of the container to another system where the guide members cooperate with guide members on the other money processing system to secure the container in an operable relationship with the other money processing system in which bank notes can be retrieved from or fed to the drum through the slot in the container; and wherein the drum can be removed from the container when desired.

14. The apparatus of claim 13 wherein a side portion of the cover and a first side wall forms the slot when the cover is closed.

15. The apparatus of claim 14 wherein the guide members are formed along opposite lower edges of the container; and wherein the cover is hinged to an upper edge of a sidewall of the container above one of the guide members such that the cover opens upwardly to allow removal of the storage roller therefrom.

16. The apparatus of claim 13, wherein a sidewall of the container has a cutout portion, said storage roller having a drive, said storage roller being mounted in the container so that the drive of the storage roller faces the cutout portion in the sidewall of the container, said cover having a front flap that encloses the cutout portion when the cover is pivoted to a position to close the container, and wherein access to the drive of the storage roller is provided when the cover is pivoted to an open position.

17. The apparatus of claim 13 which further comprises:

a damping element located on an inside portion of the cover that presses against the drum of the storage roller when the cover is closed.

18. A method of transferring bank notes between two spaced apart money processing systems, said method comprising:

providing a container having a slot;

inserting in a downwards direction a bank note storage roller having a drum around which bank notes are stored; the drum being situated in the container so that bank notes can be transferred to and from the drum through the slot;

providing guide members on outer portions of the container that cooperate with guide members on the money processing systems;

engaging the guide member of the container with guide members on one money processing system to secure the container in an operable relation with one of the money processing system;

transferring bank notes to and from the drum through the slot in the container while the container is secured to the one money processing system, removing of the container from the one money processing system with the bank note storage roller remaining therein;

transporting the container to another money processing system;

engaging the guide members of the container with guide members on another money processing system to secure the container in an operable relation with the another money processing system;

transferring bank notes to or from the drum through the slot in the container while the container is secured to the another money processing system; and removing the drum from the container in an upwards direction when desired.

* * * * *